US006276083B1

(12) United States Patent
Ross

(10) Patent No.: US 6,276,083 B1
(45) Date of Patent: Aug. 21, 2001

(54) APPARATUS FOR DISPLAYING ADVERTISING MATERIALS

(76) Inventor: James E. Ross, 9691 E. 5000 North, Grant Park, IL (US) 60940

( * ) Notice: Subject to any disclaimer, the term of this patent is extended or adjusted under 35 U.S.C. 154(b) by 0 days.

(21) Appl. No.: 09/256,243

(22) Filed: Feb. 23, 1999

Related U.S. Application Data

(60) Provisional application No. 60/076,470, filed on Mar. 2, 1998.

(51) Int. Cl.[7] ..... G09F 15/00

(52) U.S. Cl. ..... 40/607; 40/610; 116/173

(58) Field of Search ..... 248/188.5; 40/610, 40/607; 116/173

(56) References Cited

U.S. PATENT DOCUMENTS

| | | | | |
|---|---|---|---|---|
| 47,230 | | 4/1865 | Sprague . | |
| 414,903 | * | 11/1889 | Godillot | 248/188.5 |
| 1,674,565 | | 6/1928 | Peterson . | |
| 1,953,387 | * | 4/1934 | Benjamin | 248/188.5 X |
| 2,225,103 | | 12/1940 | Einermann . | |
| 2,819,547 | * | 1/1958 | Clements, Jr. | 40/610 X |
| 2,911,746 | | 11/1959 | Frey . | |
| 2,926,442 | | 3/1960 | Reimel . | |
| 3,031,161 | | 4/1962 | Hawie . | |
| 3,595,202 | | 7/1971 | Visitacion . | |
| 3,762,360 | | 10/1973 | Hawes . | |
| 3,941,083 | | 3/1976 | Morse et al. . | |
| 4,095,360 | | 6/1978 | Dinan et al. . | |
| 4,474,132 | | 10/1984 | Fritsch . | |
| 4,796,553 | | 1/1989 | Cogswell et al. . | |
| 4,864,962 | | 9/1989 | Kuehl et al. | 40/617 |
| 4,906,503 | | 3/1990 | De La Cruz et al. | 40/603 |
| 5,279,250 | | 1/1994 | Palermo, Jr. et al. . | |
| 5,402,746 | | 4/1995 | Deschamps . | |
| 5,423,281 | | 6/1995 | Crookham et al. . | |
| 5,463,973 | | 11/1995 | Tait | 40/607 |
| 5,495,821 | | 3/1996 | Brewer . | |
| 5,509,371 | | 4/1996 | Phillips . | |
| 5,522,165 | | 6/1996 | Molla | 40/604 |
| 5,694,733 | | 12/1997 | Gallemore, II | 40/607 |

* cited by examiner

*Primary Examiner*—Joanne Silbermann
(74) *Attorney, Agent, or Firm*—Walsh & Katz, Ltd.

(57) ABSTRACT

Apparatus is provided for displaying advertising information. The apparatus includes a rigid base and an upright receptacle having an inner and an outer member rigidly attached to the base. The apparatus further includes a upright mast pivotally engaging the receptacle between the inner and outer member and a relatively rigid panel adapted to display the advertising information flexibly coupled to the upright mast.

2 Claims, 4 Drawing Sheets

APPARATUS FOR DISPLAYING ADVERTISING MATERIALS

Provisional App. No. 60/076,470, filed Mar. 2, 1998.

FIELD OF THE INVENTION

The field of the invention relates to advertising and more particularly to apparatus for displaying advertising information.

BACKGROUND OF THE INVENTION

Rigidly mounted panels and billboards for displaying advertising materials are known. Such panels and billboards are available in a variety of sizes of sizes and shapes.

Other less rigidly mounted panels are also known. For example, at least one prior art device teaches of a rigid vehicular warning sign coupled to an upright intermediate rod. The intermediate rod is coupled to and rotates around a support mast. The intermediate rod is supported from a top and intermediate portion of the mast.

Another reference teaches of the use of a board supported between upper and lower cross-members. A set of coil springs are used to couple top and bottom opposing corners of the board to the cross-members.

Another reference teaches of flexible pouches displayed between two support members. The pouches are supported along an upper and lower edge at a central location. The upper support is made up of a swivel structure. The lower support is made up of a pair of closely adjacent springs.

Other references teach of rotatable tubes disposed over flagpoles and used to support a flag. The tube is moved along the pole by a supporting washer and rope. The rotatable tube allows the tube/flag combination to rotate freely around the pole allowing the flag to remain in an unfurled state.

Still further references teach of a support tube forming an oblique angle and supporting a flag on two sides. The support tube is shown as having an upright portion which engages and rotates around a shaft assembly.

While the references may be effective in certain applications, none of the references have been designed for severe wind conditions. Accordingly, a need exists for a system for displaying advertising materials which is designed for the extreme mechanical stresses associated with high winds.

SUMMARY

Apparatus is provided for displaying advertising information. The apparatus includes a rigid base and an upright receptacle having an inner and an outer member rigidly attached to the base. The apparatus further includes a upright mast pivotally engaging the receptacle between the inner and outer member and a relatively rigid panel adapted to display the advertising information flexibly coupled to the upright mast.

DETAILED DESCRIPTION OF A PREFERRED EMBODIMENT

Figure 1:
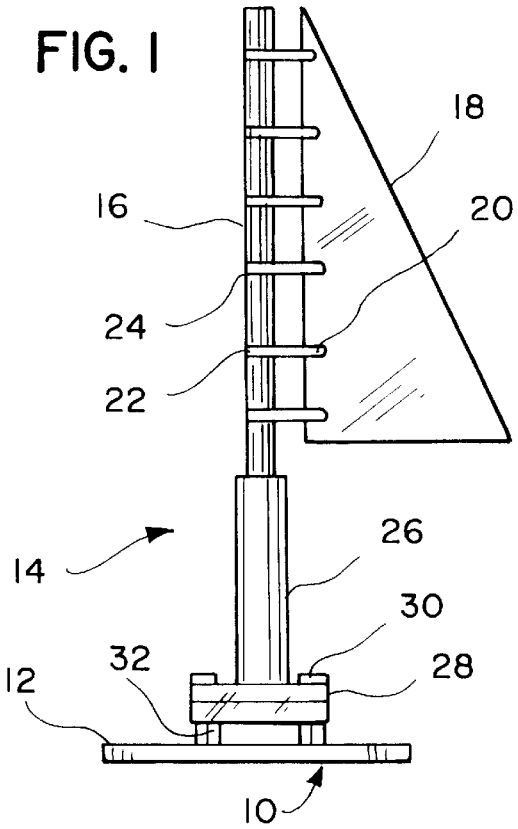
FIG. 1 depicts apparatus for displaying advertising information in accordance with an illustrated embodiment of the invention.

FIG. 1 is a side view of a novel system 10 for displaying advertising materials. Included within the system 10 is a rigid mounting plate (base) 12, a mounting receptacle 14, an upright mast 16 and substantially rigid display panel 18 for displaying advertising materials.

The upright mast 16 and mounting receptacle 14 are designed for extremely high wind conditions and allow for substantially free 360 degree rotation of the mast 16 within the receptacle 14. The mounting plate 12 may be any rigid planar material (e.g., steel, wood, PVC wood, etc.) that may be secured to a substrate (e.g., roof of a building, ground, etc.) by some appropriate method (e.g., welding, nailing, gluing, staking, etc.).

Flexibly mounted to the mast 16 is an advertising display panel 18. The display panel l8 may be fabricated of any self-supporting lightweight material (e.g., Coroplast, Versacell, etc.) which is capable of resisting heavy wind loading and which will accept advertising graphics (e.g., by printing, laminating, etc.).

The display panel 18 may be flexibly secured to the mast 16 by a number of grommets 20 (e.g., #1 or #2 brass) disposed in the panel 18 (e.g., ¾ inch from the edge) and bands 22 joining the panel 18 to the mast 16. The bands may be of a metal (e.g., stainless steel) or an appropriate plastic (e.g., nylon).

The bands 22 may be cable ties, which may be doubled-up for added strength. Silicone caulking may be disposed between the panel 18 and mast 16 to absorb shock. Silicone caulking may also be disposed between the bands 22 and panel 18 and between the bands 22 and mast 16 to further reduce the impact of severe wind loading.

The panel 18 may be restrained against vertical movement by securing a contacting portion of the band 22 to the mast 16. The band 22 may be secured to the mast 16 by an appropriate attachment system 24 (e.g., screws, glue, etc.).

In order to resist wind damage, the mast 16 is fabricated of a material which is strong, yet lightweight (e.g., steel conduit, fiberglass, Coroplast, etc.). The mast 16 may be adapted to engage the receptacle 14 on both internal and external surfaces.

The receptacle 14 may have an external case that may be made of PVC conduit 26 with an end cap 32. A flange 28 with a center hole may be placed over the conduit 26 and end cap 32. A set of bolts 30 may be used to secure the flange 28 to the base plate 12.

Figure 2:
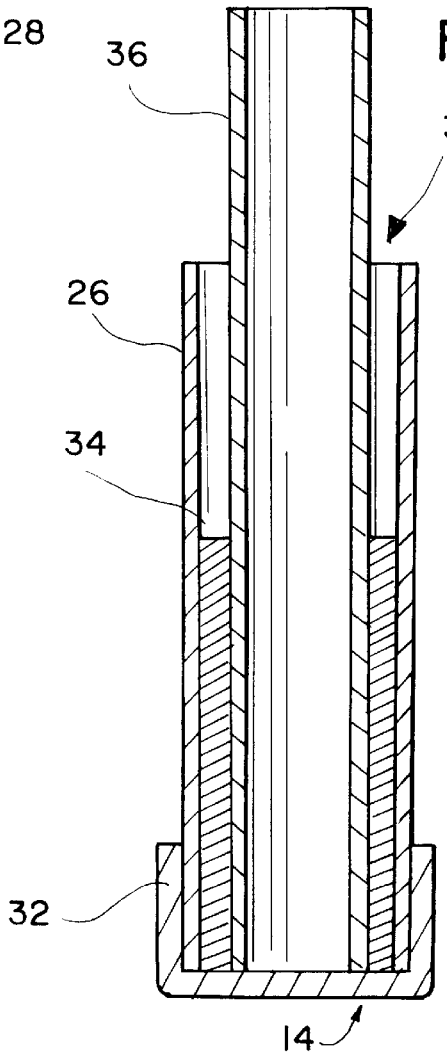
FIG. 2 depicts a cut-away view of a mounting receptacle of the apparatus of FIG. 1.

FIG. 2 is a cut-away side view of the receptacle 14. As shown, the receptacle 14 has an inner member 36 and an outer member 26. The inner member 36 may be chosen with an outer diameter of a size sufficient to fit inside the mast 16 and engage an inner surface of the mast 16. The outer member 26 is chosen with an inner diameter sufficient to allow the mast 16 to slip inside the outer member 26 to engage on outer surface of the mast 16 in a pocket 38 between the inner and outer member 26, 36. A spacer 34 is provided to prevent the mast 16 from sliding too far into the receptacle 14.

The use of a receptacle 14 which engages both an inner and outer surface of the mast 16 has proven to be extremely resistant to wind damage. Further, the presence of the pocket 38 allows for easy rotation of the mast 16 and panel 18.

For instance, the advertising display system 10 may be provided with an overall height of 52 inches. The mast 16 may be fabricated of 1 inch steel conduit. The inner member 36 may have a height of 24 inches and be fabricated of steel conduit having a ⅞ inch outside diameter. The outer member 26 may have a height of 20 inches and be fabricated of 1¼ inch FVC pipe. The spacer 34 may be 12 inches long of thin-wall PVC pipe, to closely engage both the outer diameter of the inner member 36 and the inner diameter of the outer member 26. The cap 32 may be a PVC cap glued onto the end of the outer member 26.

As shown in FIG. 2, the inner and outer members 26, 36 and spacer 34 overlap each other to a significant degree. As shown, all three tubes 26, 34, 36 are longitudinally aligned along the lower end where each tube 26, 34, 36 abuts the end cap 32.

The overlapping natures of the tubes 26, 34, 26 provides an extremely strong structure closest the base 12 where wind loading is the greatest. The internal and external support of the mast 16 resists splitting or buckling. During periods of heavy wind, the transverse forces upon the internal and external supports causes the mast 16 to wedge into the support 14 and resist detachment of the mast 16 from the receptacle 14.

In another embodiment of the invention (FIG. 3), one or more brackets 50 may be mounted to the mast 16 (or any other upright member) by a set of bands 51. An advertising panel 52, 54 may be mounted between either a first and second bracket 50 or between the bracket 50 and eye bolt 56. As above, the display panel 52, 54 may be fabricated of any self-supporting lightweight material (e.g., Coroplast, Versacell, etc.) which is capable of resisting heavy wind loading and which will accept advertising graphics (e.g., by printing, laminating, etc.).

The panels 52, 54 may be supported at an upper end by grommets 58 and bands 60 (e.g., snap-rings). The panels 52, 54 may be secured and stabilized and secured at a lower end by a resilient member 62 (e.g., a bungee cord).

Figure 4:
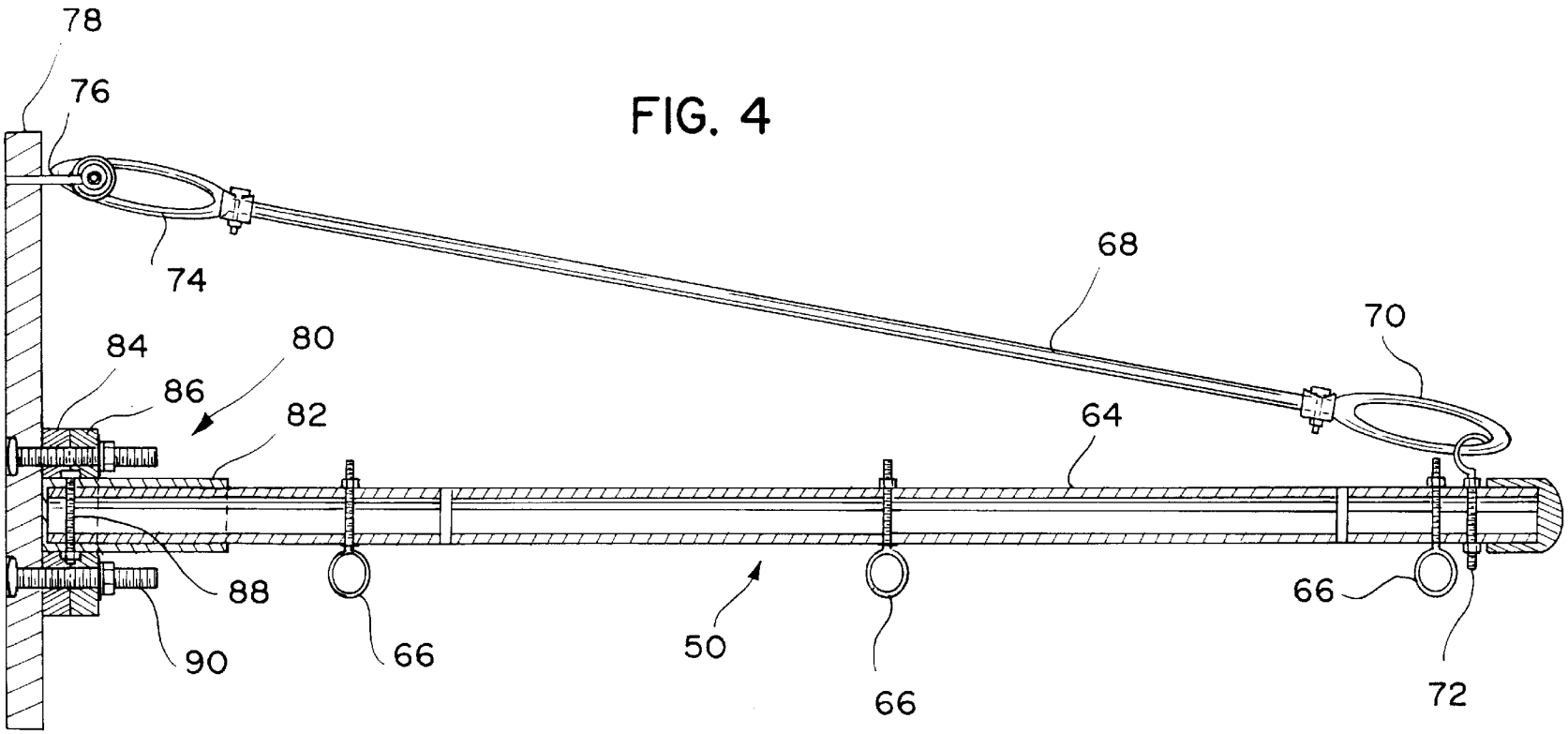
FIG. 4 depicts a mounting bracket of the apparatus of FIG. 3.

FIG. 4 is a side view of a bracket 50. As shown, the bracket may be fabricated of an appropriate structural member 64 (e.g., ¾ inch conduit, ⅞ inch fiberglass or Coroplast, 1 inch PVC, etc.). The bands 60 may be secured to the member 64 by eye bolts 66 passing through the member. Alternatively, the bands 60 may be secured to the member 64 using a sliding clip disposed around the member and having an extending loop (not shown).

Additional rigidity may be imparted to the structural member 64 by a ⅛ inch aircraft cable 68 bracing the member 64 to a rigid base 78 (e.g., ⅞×3×16 PVC wood), using open cable loops 70, 74 and eye bolts 72, 76. The member 64 may be secured to the base 78 by a bracket mount 80.

Figure 3:
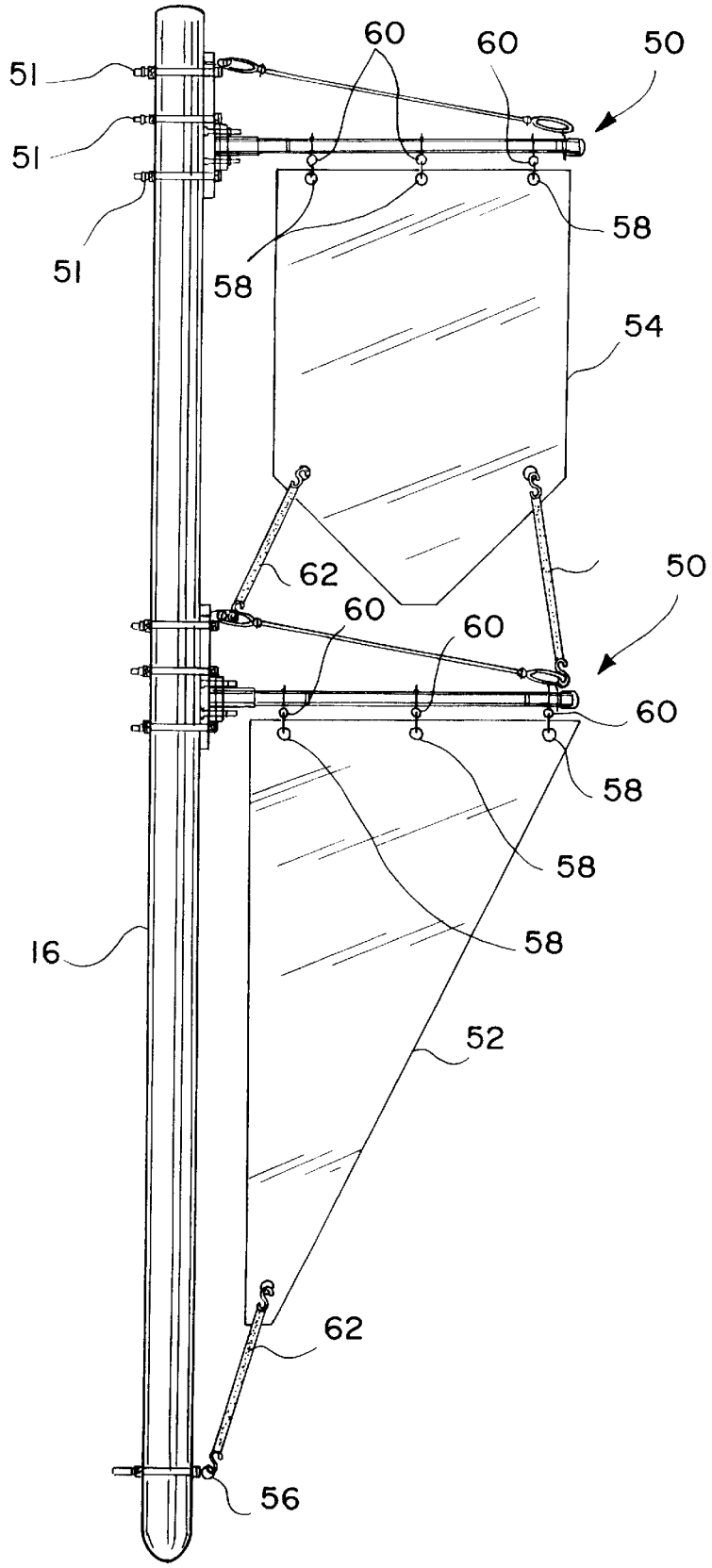
FIG. 3 depicts apparatus for displaying advertising information in accordance with an alternate, illustrated embodiment of the invention.

The bracket mount 80 may include an external sleeve 82 which slips over the structural member 64. A through bolt 88 secures the sleeve 82 to the member 64. A pair of flanges 84, 86 (e.g., made of PVC wood) slide onto the sleeve 82 from opposing ends and trap the through bolt 88 in between. A pair of bolts 90, in turn, secure the bracket mount 80 to the base 78. The base 78, in turn, may be secured to the mast 16 by through-bolts 51 (as shown in FIG. 3).

Figure 5:
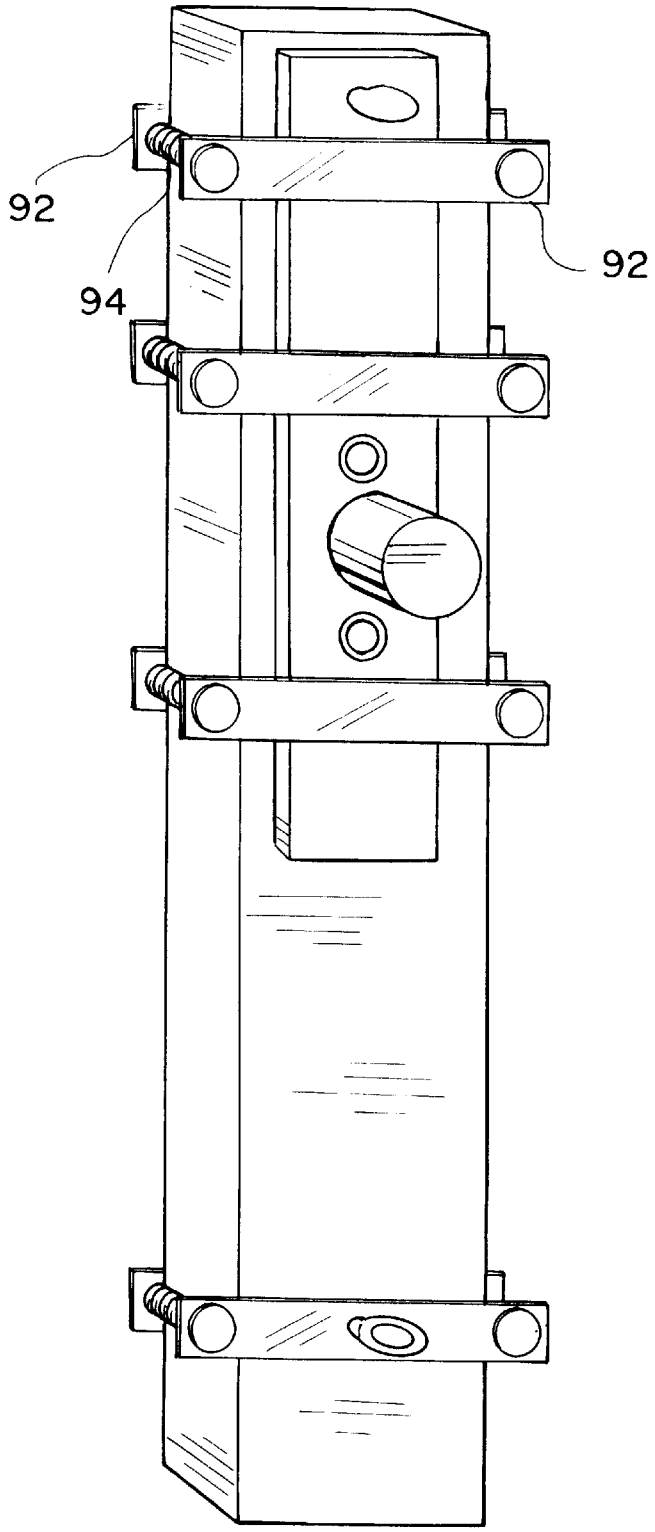
FIG. 5 depicts mounting details of the bracket of FIG. 3.

Alternatively, where the mast 16 is square (or drilling of the mast 16 is not preferred) the brackets 50 may be secured by other methods. Where drilling is not preferred, the brackets 50 may be secured to the mast 50 by rigid straps 92 (FIGS. 5) made of PVC wood. Through-bolts 94 may be provided to secure a front strap 92 to a rear strap.

A specific embodiment of a method and apparatus for displaying advertising information according to the present invention has been described for the purpose of illustrating the manner in which the invention is made and used. It should be understood that the implementation of other variations and modifications of the invention and its various aspects will be apparent to one skilled in the art, and that the invention is not limited by the specific embodiments described. Therefore, it is contemplated to cover the present invention any and all modifications, variations, or equivalents that fall within the true spirit and scope of the basic underlying principles disclosed and claimed herein.

What is claimed is:

1. Apparatus for displaying advertising information, such apparatus comprising:

a rigid base;

an upright receptacle having an inner and an outer member rigidly attached to the base;

a upright mast pivotally engaging the receptacle between the inner and outer member; and a relatively rigid panel adapted to display the advertising information flexibly coupled to the upright mast, wherein the inner and outer member of the upright receptacle further comprises two at least partially overlapping tubes, wherein the two at least partially overlapping tubes further comprises a spacer tube disposed between the inner and outer tubes, wherein the two at least partially overlapping tubes and spacer tube further comprises an arrangement wherein the spacer tube is entirely disposed around the inner tube and the outer tube is partially disposed around the spacer tube and entirely disposed around the inner tube, wherein the inner, outer and spacer tubes further comprise an arrangement wherein a first end of the inner, outer and spacer tubes are all longitudinally aligned inside and against an end cap, and wherein a second end of the outer tube extends past a second end of the spacer tube.

2. Apparatus for displaying advertising information, such apparatus comprising:

a rigid base;

a upright mast extending upwards from the rigid base;

means for pivotally coupling the upright mast to the rigid base;

a relatively rigid panel adapted to display the advertising information from the upright mast; and means for flexibly coupling the rigid panel to the upright mast, wherein the means for coupling further comprises an upright receptacle having an inner and an outer member rigidly attached to the base, wherein the inner and outer member of the upright receptacle further comprises two at least partially overlapping tubes, wherein the two at least partially overlapping tubes further comprises a spacer tube disposed between the inner and outer tubes, wherein the two at least partially overlapping tubes and spacer tube further comprises an arrangement wherein the spacer tube is entirely disposed around the inner tube and the outer tube is partially disposed around the spacer tube and entirely disposed around the inner tube, wherein the inner, outer and spacer tubes further comprise an arrangement wherein a first end of the inner, outer and spacer tubes are all longitudinally aligned inside and against an end cap, and wherein a second end of the outer tube extends past a second end of the spacer tube.

* * * * *